US006716154B2

(12) United States Patent
Witthaus et al.

(10) Patent No.: US 6,716,154 B2
(45) Date of Patent: Apr. 6, 2004

(54) CENTRIFUGE WITH A FLUID LINE GUIDE ELEMENT HAVING A CURVED BEARING SURFACE

(75) Inventors: Friedrich Witthaus, Namborn (DE); Wolfram Weber, Spiesen-Elversberg (DE)

(73) Assignee: Fresenius HemoCare GmbH, Bad Homburg (DE)

( * ) Notice: Subject to any disclaimer, the term of this patent is extended or adjusted under 35 U.S.C. 154(b) by 32 days.

(21) Appl. No.: 10/228,553

(22) Filed: Aug. 27, 2002

(65) Prior Publication Data

US 2003/0045419 A1 Mar. 6, 2003

(30) Foreign Application Priority Data

Aug. 31, 2001 (DE) ..... 101 42 744

(51) Int. Cl.[7] ..... B04B 7/00
(52) U.S. Cl. ..... 494/83
(58) Field of Search ..... 494/12, 18, 21, 494/45, 83, 84, 85; 210/380.1, 781, 782

(56) References Cited

U.S. PATENT DOCUMENTS

| | | | | |
|---|---|---|---|---|
| 4,109,852 A | * | 8/1978 | Brown et al. | 494/18 |
| 4,111,356 A | | 9/1978 | Boggs et al. | |
| 4,114,802 A | | 9/1978 | Brown | |
| 4,120,448 A | * | 10/1978 | Cullis | 494/43 |
| 4,164,318 A | * | 8/1979 | Boggs | 494/18 |
| 4,221,322 A | | 9/1980 | Drago et al. | |
| 4,439,178 A | * | 3/1984 | Mulzet | 494/85 |
| 4,710,161 A | * | 12/1987 | Takabayashi et al. | 494/84 |
| 5,514,069 A | * | 5/1996 | Brown et al. | 494/18 |
| 5,704,887 A | * | 1/1998 | Slowik et al. | 494/12 |
| 5,989,177 A | * | 11/1999 | West et al. | 494/46 |
| 6,273,849 B1 | * | 8/2001 | Scherer | 494/37 |
| 6,344,020 B1 | * | 2/2002 | Reitz et al. | 494/46 |

FOREIGN PATENT DOCUMENTS

| | | |
|---|---|---|
| DE | 26 12 988 | 10/1976 |
| DE | 2845364 | 4/1979 |
| DE | 2845399 | 4/1979 |
| DE | 32 42 541 | 5/1984 |
| DE | 42 20 232 | 12/1993 |
| DE | 0 619 144 | 10/1994 |
| DE | 198 03 535 | 8/1999 |
| EP | 112 990 | 7/1984 |
| FR | 2305238 | * 10/1976 |
| WO | 93/12887 | * 7/1993 |
| WO | WO 95/17261 | 6/1995 |

* cited by examiner

*Primary Examiner*—Charles E. Cooley
(74) *Attorney, Agent, or Firm*—Kenyon & Kenyon

(57) ABSTRACT

A centrifuge having a rotating frame, which is rotatably mounted on a stationary frame, and a separation unit mounted on the rotating frame, rotating about a central axis of rotation in the same direction of rotation as the rotating frame but at twice the rotational speed. A line for supplying and/or removing a fluid is connected to the separation unit and is guided in a loop about the separation unit to a stationary tie-in point. To support the line, at least one guide element having a bearing surface for the line is provided. The bearing surface of the guide element is formed by a rotating planar curve, where the radius of the respective circle of curvature contacts the curve at a point and increases with increasing distance between the contact point and the central axis of rotation. With this contour, abrasion over the entire contact surface is largely uniform, which thereby lengthens the lifetime.

9 Claims, 3 Drawing Sheets

CENTRIFUGE WITH A FLUID LINE GUIDE ELEMENT HAVING A CURVED BEARING SURFACE

FIELD OF THE INVENTION

The present invention relates to a centrifuge, in particular a continuous-flow centrifuge without face seals for centrifuging biological fluids.

BACKGROUND OF THE INVENTION

Centrifuges are known in which the biological fluid is centrifuged in continuous flow. The fluid is supplied to a rotating centrifuge chamber and removed from the chamber through a line. Because of the relative movement of the centrifuge chamber and the stationary tie-in point of the line, however, guidance of the line has proven to be problematical. To prevent twisting of the line, rotating seals are used at the tie-in points of traditional continuous-flow centrifuges. Such continuous-flow centrifuges allow a high rotational speed, but the rotational couplings may lead to leakage and damage to components contained in the fluid.

A blood centrifuge without face seals is disclosed in German Patent 32 42 541 A1. With this centrifuge, which does not use face seals, the line passes from a stationary tie-in point in a loop around the centrifuge chamber. Therefore, the line is connected to a rotating frame which rotates at half the rotational speed of the centrifuge chamber. Such a continuous-flow centrifuge is known from German Patent 42 20 232 A1, for example.

In the case of continuous-flow centrifuges that do not use face seals, the line is exposed to relatively great mechanical stresses that increase greatly with an increase in rotational speed. Under the influence of centrifugal forces, the line forms a loop protruding outward, so that high reversed bending loads occur at the stationary tie-in point and the connection to the separation chamber. The steep inlet and outlet angles at the tie-in points lead to additional friction between the connection adaptors and the line, which in turn results in increased abrasion. The reversed bending load and abrasion are the factors which limit the lifetime of the line and the maximum rotational speed of the centrifuge.

Continuous-flow centrifuges that do not use face seals are known, whereby bearings are used to support the line. For example, European Patent 112 990 A1 describes a continuous-flow centrifuge in which the centrifuge tubing is supported between the stationary tie-in point and the connection of the separation chamber to two friction bearings. The friction bearings, consisting of inner and outer bearing shells, are components of the centrifuge tubing. As disposable items, the friction bearings are simple and economical to manufacture but they have relatively high friction losses, particularly at high rotational speeds.

International Patent Application WO 95/17261 A1 describes a continuous-flow centrifuge in which the centrifuge tubing is supported with a roller bearing mounted on the rotating frame. The roller bearing, consisting of the inner and outer bearing shells with the roller bodies is part of the line. Although the roller bearing offers the advantage of low bearing friction, it is complicated to manufacture and therefore the price is relatively high. This is important inasmuch as the centrifuge line is a disposable item which is discarded after use. A continuous-flow centrifuge which does not use face seals and has a bearing for supporting the fluid line is also known from German Patent 198 03 535 A1.

U.S. Pat. No. 4,221,322 describes a continuous-flow centrifuge in which the fluid line is supported on a rotationally symmetrical bearing surface having a section formed by a rotating arc. U.S. Pat. No. 4,111,356 proposes a guide element for supporting the fluid line which also has a rotationally symmetrical bearing surface.

SUMMARY OF THE INVENTION

The object of the present invention is to create a centrifuge that can be manufactured especially easily and inexpensively, whose line for supplying and/or removing the fluid is adequately supported on the one hand while on the other hand being exposed to relatively low mechanical stresses so that high rotational speeds are possible. In addition, it is especially simple and inexpensive to manufacture the line.

The bearing surface of the guide element supporting the line of the centrifuge according to the present invention is formed by a rotating planar curve, where the radius of the respective circle of curvature, which contacts the curve at a point, increases with an increase in distance between the point of contact and the central axis of rotation of the centrifuge. This yields the result that abrasion of the guide element and the line is largely uniform over the entire bearing surface. It has been found by the present invention that the lifetime of the line is improved by uniform abrasion.

The quotient of the respective radius of curvature R2 and the respective distance R1 between the contact point and the axis of rotation should be as constant as possible over the course of the curve describing the bearing surface of the guide element. The constant $a=R2/R1$ is greatly influenced by the materials used and the geometric boundary conditions. In particular, the flexural rigidity of the line is important. It has been found by the present invention that its lifetime can be increased particularly when $1 \leqq a \leqq 2$.

In a preferred embodiment of the present invention, the guide element is a sleeve-shaped body which surrounds the line. Both the guide element and the line are preferably made of abrasion-resistant materials which can slide easily on one another without the use of a lubricant.

In an especially preferred embodiment of the present invention, the bearing surface of the guide element is connected to a cylindrical guide section whose diameter is preferably such that the line is guided loosely in it. The cylindrical guide section is used to guide a straight section of the line, while the bearing surface serves to support a bent line section downstream from the former.

To support the line, the centrifuge preferably has two guide elements. The first guide element is provided on the side of the separation unit which faces away from the stationary tie-in point. With this guide element, the line extending away from the separation unit is guided in a loop around the separation unit to the stationary tie-in point, whereupon a first section of the line is supported on the bearing surface of the guide element.

The second guide element which is provided at the stationary tie-in point is supported with its second bearing surface on a second section of the line which is guided about the separation unit.

With the bearing surfaces according to the present invention on the two guide elements, the line is supported so that it is exposed to relatively low mechanical stresses so that high rotational speeds are possible even after lengthy standing times. In principle, however, only the one guide element or the other may have the bearing surface according to the present invention.

Depending on the shape of the loop in which the line is to be guided, other guide elements may also be provided. Each guide element may also have two of the bearing surfaces according to the present invention to provide support for the line.

DETAILED DESCRIPTION

A representative embodiment of the present invention is described in greater detail below with reference to the drawings.

Figure 1:
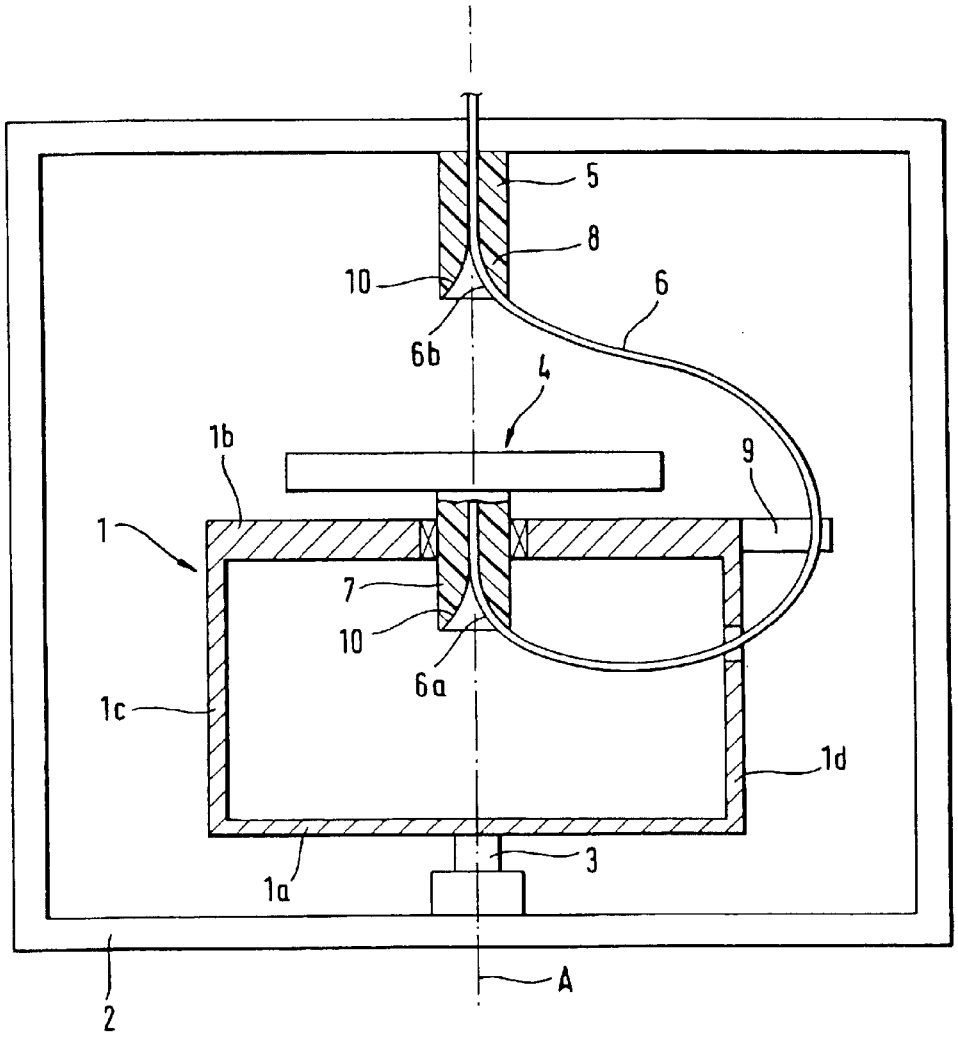
FIG. 1 shows a greatly simplified schematic diagram of an embodiment of a continuous-flow centrifuge without face seals for centrifuging biological fluids, in particular blood.

FIG. 1 shows a schematic diagram of a continuous-flow centrifuge that does not use face seals for centrifuging a biological fluid, in particular blood, which corresponds in design and function to the centrifuge described in German Patent 32 42 541 A1. The continuous-flow centrifuge has a rotating frame 1 with a lower supporting plate 1*a* and an upper supporting plate 1*b* plus two side parts 1*c*, 1*d*. Rotating frame 1 is rotatably mounted on a stationary frame 2 to rotate about a vertical axis 3, and it is driven by a drive unit (not shown in FIG. 1) at a rotational speed $n_1$. A separation unit 4 in the form of a cylindrical chamber is mounted on the upper supporting plate 1*b* of the rotating frame 1 so it can rotate about the axis of rotation of rotating frame 1. Separation unit 4 is driven by a drive unit (not shown) in the same direction of rotation as the rotating frame 1 but at twice the rotational speed $n_2=2n_1$. Separation unit 4 may also be mounted on the lower side of supporting plate 1*b*.

The central axis of rotation, about which the separation unit 4 as well as the rotating frame 1 rotate, is labeled with reference notation A in FIG. 1.

A flexible line 6, which combines one or more tubes for supplying and removing the blood or blood constituents into and out of separation unit 4, leads from a stationary tie-in point 5 of the centrifuge frame and around separation unit 4 and is connected to its lower side. Twisting of the line is prevented by the fact that line 6 passes around the separation unit at half the rotational speed in comparison with separation unit 4.

Line 6 is part of a disposable set which includes, in addition to separation unit 4, bags for collecting the blood components separated by centrifugation. The disposable set is inserted into the centrifuge and discarded after use. Such tubing arrangements are well known in the art, and as such would be familiar to and readily understood by one of ordinary skill in the art. For example, a disposable set including multiple collecting bags is described in German Patents 28 45 364 A1 and 28 45 399 A1, which are hereby incorporated by reference in their entireties.

To reduce the mechanical stress on line 6 due to centrifugal forces, it is supported at the stationary tie-in point 5 as well as at the side of the separation unit 4, which faces away from the stationary tie-in point 5. Therefore, a first guide element 7 is provided on the lower side of the separation unit, supporting a first section 6*a* of line 6. A second guide element 8 is provided at the stationary tie-in point 5 to support a second line section 6*b*. The two guide elements 7, 8 have an identical structure. The line may be attached to a side arm 9 at the upper supporting plate 1*b* of the frame with another guide element (not shown) or bearing.

Figure 2:
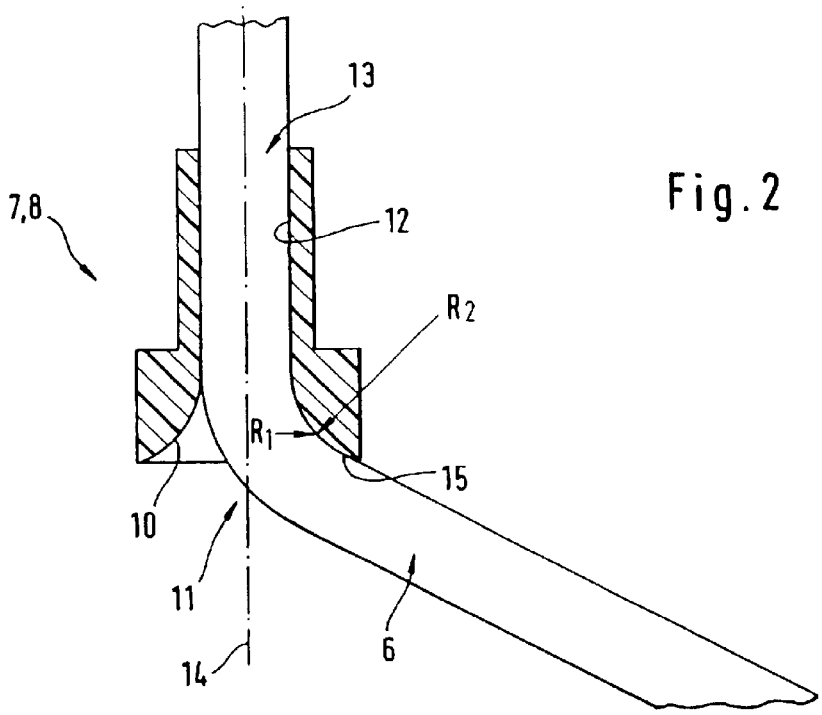
FIG. 2 shows a schematic diagram of one of the two guide elements of the centrifuge from FIG. 1 in an enlarged drawing together with a section of the centrifuge line.

FIG. 2 shows a schematic diagram of one of the two guide elements 7, 8 of the centrifuge, which is described with reference to FIG. 1 in a sectional diagram.

Guide element 7, 8 is a sleeve-shaped body made of ABS plastic in particular. It has a rotationally symmetrical bearing face 10 for supporting a curved section 11 of line 6, to which is connected a cylindrical guide face 12 for guiding a straight section 13 of line 6. Cylindrical guide face 12 has a diameter slightly greater than the outside diameter of line 6, so that the line is loosely guided in the guide element.

Rotationally symmetrical bearing face 10 of guide element 7, 8 is formed by a planar curve 15 rotating about longitudinal axis 14 of the guide element, the course of which is just indicated in FIG. 2. Longitudinal axis 14 of the guide element lies on the axis of rotation A of the centrifuge.

Without intending to be limited to the theory of how the present invention works, what follows is a description of the theoretical background to explain abrasion of line 6 and guide elements 7, 8 as well as the exact contour of the bearing surface for minimizing abrasion and prolonging the lifetime of both the line and the guide element.

The abrasion of two surfaces rubbing against one another can be described in first approximation by the following equation:

$$A \sim V^{*}P$$

Abrasion A is proportional to the relative velocity V of the two surfaces rubbing against one another and their surface pressure P.

In the case of the tubing connection, the relative velocity is not constant but instead is proportional to the radial distance R1 from the central axis of rotation A of the centrifuge.

$$V \sim R1$$

The surface pressure depends on forces which are caused by bending of the line and by tensile force due to the centrifugation.

$$P=P1+P2$$

P1 increases in proportion to the smaller bending radius R2 according to the laws of the bending beam, and P2 also increases in proportion to the decrease in the bending radius R2 according to the laws of cable looping. The following thus holds for the total surface pressure P:

$$P \sim 1/R2$$

This yields the following equation for abrasion:

$$A \sim R1/R2$$

The contour of bearing surface 10 of guide element 7, 8 should be such that abrasion remains as unchanged as possible over the entire bearing surface. It follows from this that the quotient of the two radii R1 and R2 is as constant as possible over the course of curve 15 which describes the bearing surface.

$$R2/R1=a$$

Figure 3:
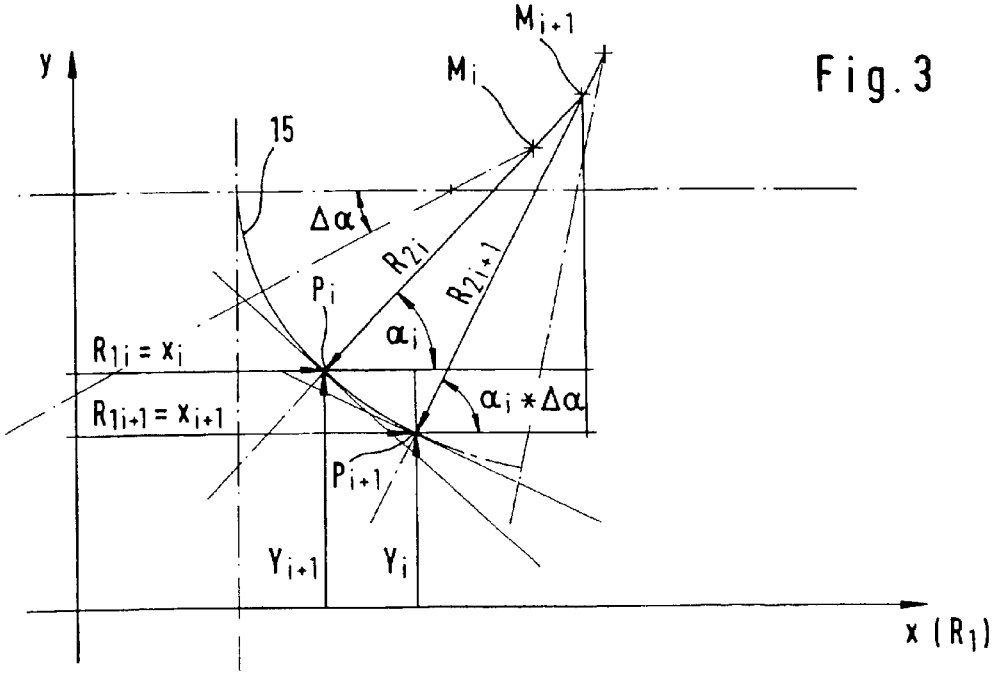
FIG. 3 shows the contour of the bearing surface of the guide element from FIG. 2.

FIG. 3 shows the exact curve describing the bearing surface. Let us assume that the central axis of rotation A of the centrifuge passes through the point of origin of the Cartesian coordinate system (y axis).

The course of the curve is described by the following equations:

$$x_{(i+1)}=R_{1(i+1)}=R_{1i}+R_{li}*a*(\cos\alpha_i-\cos(\alpha_i+\Delta\alpha)) \quad (1)$$

$$Y_{(i+1)}=Y_l+R_{li}*a*(-\sin\alpha_1+\sin(\alpha_1+\Delta\alpha)) \quad (2)$$

$$\Delta\alpha=\Delta\alpha_1=\text{const.} \quad (3)$$

$$\alpha_1=i*\Delta\alpha \quad (4)$$

The radius R2 of the respective circle of curvature, which contacts the curve at a point, increases with an increase in distance R1 between the point of contact and the central axis of rotation.

For example, the circle of curvature contacting the curve at point $P_i$ has radius of curvature $R_{2i}$. The distance between contact point $P_i$ and central axis of rotation A (y axis) is $R_{1i}=x_i$. The circle of curvature contacted by the curve at point $P_{i+1}$ has the radius $R_{2i+1}$. The distance between the point of contact $P_{i+1}$ and the axis A of rotation (y axis) is $R_{1i+1}=x_{i+1}$. As shown in FIG. 3, the point of contact $P_{1+l}$ is a greater distance from the y axis than is the point of contact $P_i$. Consequently, the radius of curvature at point $P_{i+1}$ must be greater than the radius of curvature at point $P_i$, which is shown in FIG. 3. The middle points of the circles of curvature are labeled as $M_{i,i+1}$ in FIG. 3.

Figure 4:
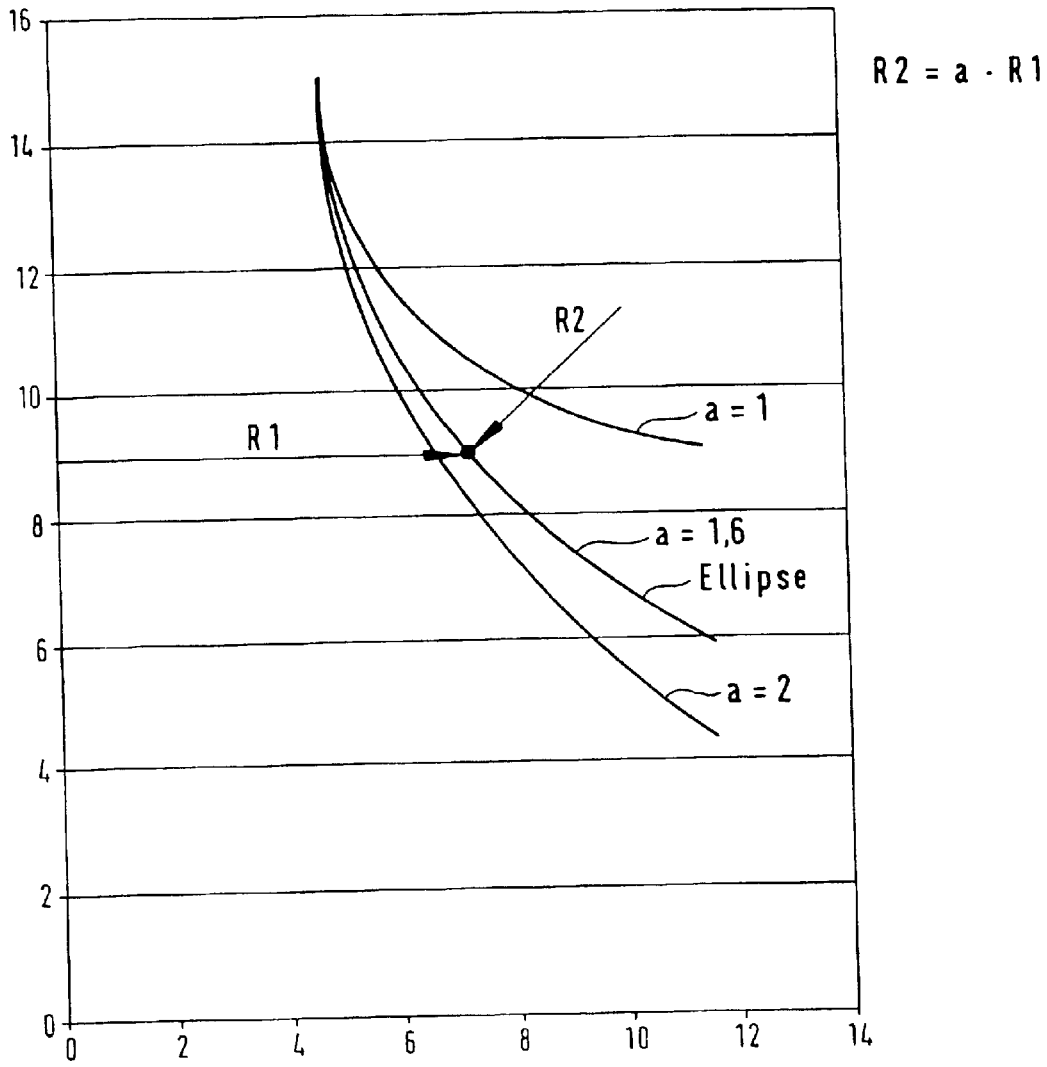
FIG. 4 shows additional embodiments of different contours of the bearing surface of the guide element from FIG. 2.

According to the present invention, it has been found in practice that long lifetimes can be achieved particularly when $1\leqq a<2$. FIG. 4 shows the contour of the bearing surface for a=1, a=1.6 and a=2. Preferably, the contour should run between the limits of a=1 and a=2.

At a constant a=1.6, the abrasion is distributed largely uniformly over the entire surface of contact. In the case of a centrifuge rotating at a rotational speed of 4,000 L/min, the lifetime could be increased to approximately nine hours with such a contour. The curve describing the bearing surface may also be approximated with an ellipse.

What is claimed is:

1. A centrifuge comprising:

a stationary frame;

a rotating frame which is rotatably mounted on the stationary frame;

a separation unit mounted on the rotating frame, wherein the separation unit rotates about a central axis of rotation in the same direction of rotation as the rotating frame but at twice the rotational speed;

a line for at least one of supplying and removing at least one fluid, wherein the line is connected to the separation unit and guided in a loop about the separation unit to a stationary tie-in point; and at least one guide element having a bearing surface, wherein the line is supported on the bearing surface and the bearing surface is formed by a rotating planar curve;

wherein at a contact point, P, on the rotating planar curve, a respective circle of curvature contacts the rotating planar curve, and wherein the radius of the respective circle of curvature increases with an increase in the distance between the contact point, P, and the central axis of rotation.

2. The centrifuge according to claim 1, wherein the quotients of the radius of the respective circle of curvature divided by the distance between the contact point, P, and the central axis of rotation is equal to a constant, a.

3. The centrifuge according to claim 2, wherein the value of the constant, a, satisfies the following equation:

$$1\leqq a\leqq 2.$$

4. The centrifuge according to claim 1, wherein the at least one guide element comprises a sleeve-shaped body.

5. The centrifuge according to claim 1, wherein the bearing surface is connected to a cylindrical guide surface.

6. The centrifuge according to claim 5, wherein the diameter of the cylindrical guide surface is slightly greater than the outside diameter of the line, such that the line is loosely guided in the at least one guide element.

7. The centrifuge according to claim 1, wherein the at least one guide element comprises a first guide element having a bearing surface, wherein the first guide element is provided on the side of the separation unit that faces away from the stationary tie-in point, and wherein a first section of the line is supported on the bearing surface of the first guide element.

8. The centrifuge according to claim 7, wherein the at least one guide element further comprises a second guide element having a bearing surface, wherein the second guide element is provided at the stationary tie-in point, and wherein a second section of the line is supported on the bearing surface of the second guide element.

9. The centrifuge according to claim 1, wherein the at least one guide element comprises a second guide element having a bearing surface, wherein the second guide element is provided at the stationary tie-in point, and wherein a second section of the line is supported on the bearing surface of the second guide element.

* * * * *

UNITED STATES PATENT AND TRADEMARK OFFICE

CERTIFICATE OF CORRECTION

PATENT NO. : 6,716,154 B2
DATED : April 6, 2004
INVENTOR(S) : Witthaus et al.

It is certified that error appears in the above-identified patent and that said Letters Patent is hereby corrected as shown below:

Column 5,
Line 33, change "$1 \leqq a \leq 2$" to -- $1 \leq a \leq 2$ --;

Column 6,
Line 21, change "$1 \leqq a \leqq 2$" to -- $1 \leq a \leq 2$ --.

Signed and Sealed this

Fourteenth Day of December, 2004

JON W. DUDAS
*Director of the United States Patent and Trademark Office*